US009283774B2

(12) United States Patent
Miyasaka

(10) Patent No.: US 9,283,774 B2
(45) Date of Patent: Mar. 15, 2016

(54) PRINT APPARATUS

(71) Applicant: SEIKO EPSON CORPORATION, Tokyo (JP)

(72) Inventor: Hidekatsu Miyasaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 20 days.

(21) Appl. No.: 14/446,952

(22) Filed: Jul. 30, 2014

(65) Prior Publication Data

US 2015/0077490 A1 Mar. 19, 2015

(30) Foreign Application Priority Data

Sep. 19, 2013 (JP) ..... 2013-194147

(51) Int. Cl.

| | |
|---|---|
| ***B41J 2/01*** | (2006.01) |
| ***B41J 11/00*** | (2006.01) |
| ***B41J 29/377*** | (2006.01) |
| ***B41J 15/16*** | (2006.01) |

(52) U.S. Cl.

CPC ..... *B41J 11/002* (2013.01); *B41J 11/004* (2013.01); *B41J 15/165* (2013.01); *B41J 29/377* (2013.01)

(58) Field of Classification Search

CPC ..... B41J 11/002; B41J 11/02; B41J 11/06; B41J 11/0085; B41J 11/04; B41J 11/26; B41J 29/377

USPC ..... 347/220, 101, 102

See application file for complete search history.

(56) References Cited

U.S. PATENT DOCUMENTS

| | | | | |
|---|---|---|---|---|
| 5,023,111 | A * | 6/1991 | Fulton et al. | 427/164 |
| 5,296,873 | A * | 3/1994 | Russell et al. | 346/25 |
| 5,754,208 | A * | 5/1998 | Szlucha | 347/102 |
| 5,825,397 | A * | 10/1998 | Fujishiro | 347/212 |
| 6,386,697 | B1 * | 5/2002 | Yamamoto et al. | 347/103 |
| 7,097,374 | B2 * | 8/2006 | Sugiura | B41J 11/06 347/89 |
| 8,292,419 | B2 * | 10/2012 | Hori | 347/102 |
| 8,459,789 | B2 * | 6/2013 | Yazawa | 347/102 |
| 2001/0051066 | A1 * | 12/2001 | Sawano | 400/120.01 |
| 2003/0227533 | A1 * | 12/2003 | Yokoi | 347/156 |
| 2004/0179080 | A1 * | 9/2004 | Hasebe et al. | 347/102 |
| 2007/0052786 | A1 * | 3/2007 | Nakazawa | 347/102 |
| 2007/0165091 | A1 * | 7/2007 | Oishi | 347/102 |
| 2010/0141726 | A1 * | 6/2010 | Kawakami et al. | 347/102 |

(Continued)

FOREIGN PATENT DOCUMENTS

JP 2005-096374 A 4/2005

OTHER PUBLICATIONS

Kanoglu, Radiation Heat Transfer, Univerisity of Gaziantep, McGraw-Hill, 2011.*

*Primary Examiner* — Matthew Luu
*Assistant Examiner* — Patrick King
(74) *Attorney, Agent, or Firm* — Global IP Counselors, LLP

(57) ABSTRACT

A print apparatus includes a print part configured to discharge a liquid onto a recording medium being conveyed, an irradiation part configured irradiate the recording medium, onto which the liquid has been discharged, with light, and a backup part provided to an opposite side of the irradiation part relative to the recording medium and having a regulating surface where a surface oriented toward the recording medium regulates movement of the recording medium in a direction of drawing away from the irradiation part, the regulating surface has an opening, and an irradiation area for the light irradiated from the irradiation part fits inside the opening as viewed in a plan view.

9 Claims, 8 Drawing Sheets

(56) References Cited

U.S. PATENT DOCUMENTS

2010/0220162 A1* 9/2010 Schierholz ..... B41J 11/002 347/102
2012/0133716 A1* 5/2012 Aizawa et al. ..... 347/102
2013/0044169 A1* 2/2013 Chiwata ..... 347/102
2013/0050376 A1* 2/2013 Houjou ..... 347/104

* cited by examiner

PRINT APPARATUS

CROSS-REFERENCE TO RELATED APPLICATIONS

This application claims priority to Japanese Patent Application No. 2013-194147 filed on Sep. 19, 2013. The entire disclosure of Japanese Patent Application No. 2013-194147 is hereby incorporated herein by reference.

BACKGROUND

1. Technical Field

The present invention relates to a print apparatus for irradiating a recording medium after printing with light.

2. Related Art

Techniques for recording an image onto a recording medium such as paper or a resin sheet include one where a photo-curable ink is first adhered to the recording medium and then the recording medium is irradiated with light to cure the ink. Here, a case where a light source is arranged so as to be close to and face the recording medium requires heat radiation from the light source in order to prevent the print process from being impacted by the heat that is emitted from the light source. For example, Japanese laid-open patent publication No. 2005-096374 describes a technique that achieves cooling of a recording medium being passed through by providing heat dissipation fins to a reverse surface of a platen that is arranged at a position facing a light irradiation device and supports the recording medium.

Though not considered in the prior art described above, a light source not only heats the recording medium but also has the effect of raising the temperature of the platen. In particular, in a print apparatus that addresses recording media of various different sizes, the range of irradiation of light is set according to the largest size of recording medium, and therefore a greater amount of heat is directly radiated toward the platen that is exposed from the recording medium when a smaller-sized recording medium is being used, making it impossible to disregard the rise in temperature of the platen. Namely, the effect of cooling for the recording medium is not obtained when the temperature of the platen is not sufficiently lower than that of the recording medium, and when the temperature rises to above that of the recording medium then the platen instead will have the effect of heating the recording medium. To solve this problem, it is necessary for the heat dissipation capacity of the platen to be made fairly high.

SUMMARY

Several aspects as in the present invention solve this problem and provide features with which a rise in temperature of a recording medium caused by heat emitted from a light source can be effectively curbed and the impact on the print process can be reduced.

One aspect of the invention is a print apparatus that comprises a print part configured to discharge a liquid onto a recording medium being conveyed, an irradiation part configured to irradiate the recording medium, onto which the liquid has been discharged, with light, and a backup part that is provided to an opposite side of the irradiation part relative to the recording medium and has a regulating surface where a surface oriented toward the recording medium regulates movement of the recording medium in a direction of drawing away from the irradiation part, the regulating surface has an opening, and an irradiation area for light irradiated from the irradiation part fits inside the opening as viewed in a plan view.

According to the configuration of such description, the light emitted from the irradiation part is not incident on the regulating surface of the backup member, and a direct rise in temperature of the regulating surface caused by light irradiation is avoided. For this reason, heating of the recording medium from the regulating surface is avoided, even when, for example, the recording medium is in contact with the regulating surface. Therefore, a rise in temperature of the recording medium is effectively curbed, and the impact on the printing process can be reduced.

More specifically, for example, the configuration may be one provided with a heat dissipation part that has a light-receiving surface onto which the light having passed through the opening is incident and that is configured to transport and dissipate heat received by the light-receiving surface to a heat dissipation space different from a gap space between the recording medium and the light-receiving surface, a distance between the recording medium and the light-receiving surface being made to be greater than a distance between the recording medium and the regulating surface. With the configuration of such description, in addition to the fact that the thermal energy incident on the light-receiving surface is quickly dissipated, the impact of the heat radiation from the light-receiving surface on the recording medium can also be reduced more, and therefore a rise in temperature of the recording medium can be more effectively curbed.

In such a case, for example, the configuration may be one where the heat dissipation part has a planar light-receiving part of which one principal surface serves as a light-receiving surface, and a heat dissipation fin that is provided to a surface of the light-receiving part on an opposite side to the light-receiving surface and are exposed to the heat dissipation space. With the configuration of such description, the heat of the light-receiving part is efficiently dissipated to the heat dissipation space via the heat dissipation fins. In particular in a case where the light-receiving part is constituted of a material having a higher thermal conductivity than that of a material constituting the regulating surface, the heat received by the light-receiving surface can be quickly moved and dissipated to the heat dissipation fins.

The present print apparatus may also be provided with, for example, an air flow generation part configured to create an air flow in the heat dissipation space. According to the configuration of such description, the heat released to the heat dissipation space can be moved farther away, and the effect of heat dissipation by a heat-dissipating means can be further enhanced. In such a case, an isolating part configured to isolate the recording medium from the air flow being generated may be further provided. According to the configuration of such description, warmed air is prevented from flowing in toward the recording medium, and it is possible to avoid the problem where the air flow hits against the recording medium and the conveyance of the recording medium is disturbed.

In the present print apparatus, for example, the irradiation part may have a lamp light source. A lamp light source is capable of emitting intense light, and can enhance the effect of irradiating the recording medium with light. On the other hand, a lamp light source generally releases a large amount of heat, and a larger amount of heat would be emitted to the recording medium. Therefore, when the lamp light source is combined with a configuration where a rise in temperature of the recording medium is effectively curbed, such as described above, then a rise in temperature of the recording medium caused by the emission of heat from the lamp light source can also be effectively curbed.

As another example, the opening of the backup part may be closed off by a window member that is transparent to the light irradiated from the irradiation part. With the configuration of such description, even when light passing through the opening is incident on some member or another and the surrounding air is thereby warmed, this air is prevented from flowing in toward the recording medium.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
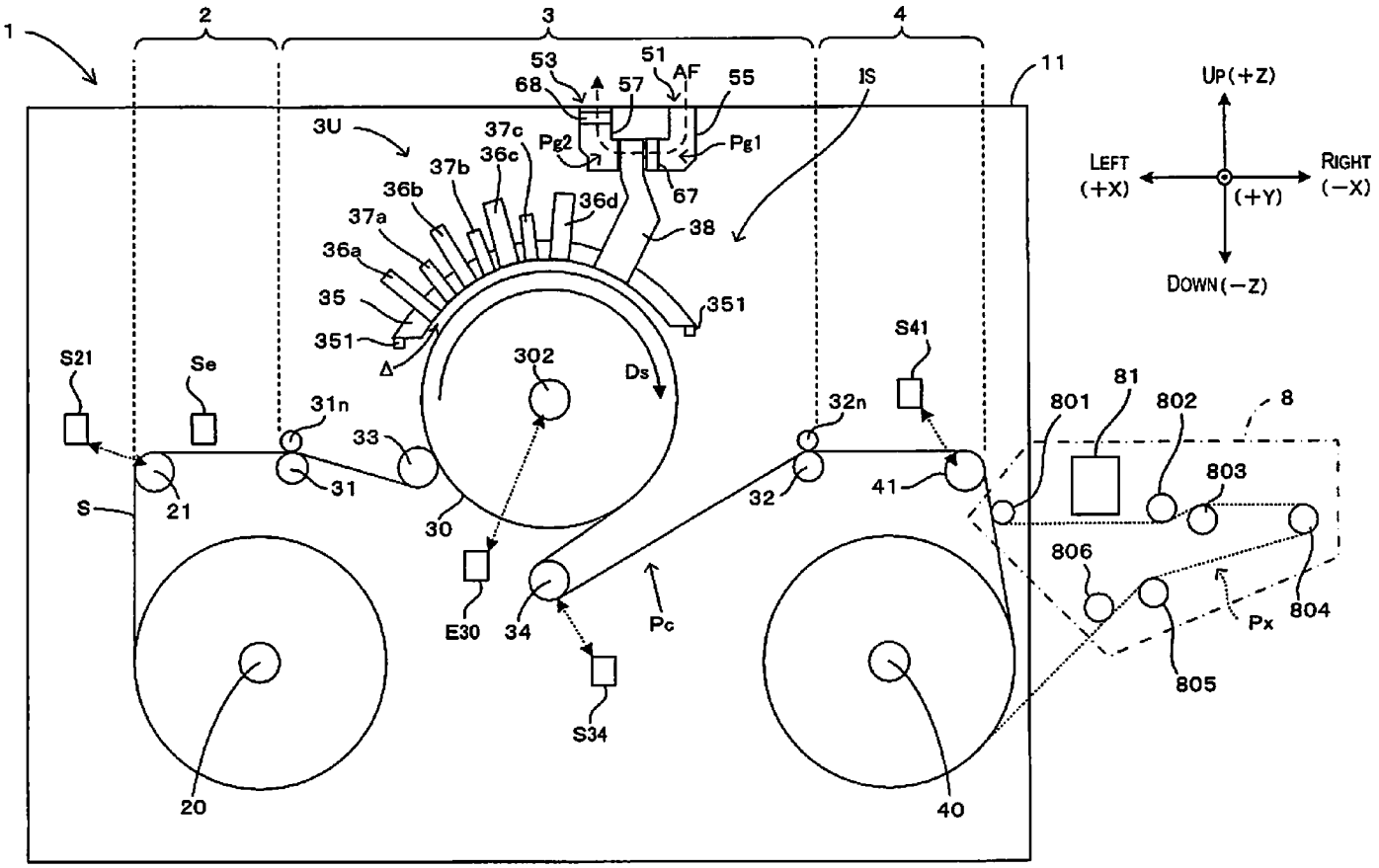
FIG. 1 is a front view illustrating by pattern diagram an example of a schematic configuration of a print apparatus to which the present invention can be applied.

FIG. 1 is a front view illustrating by pattern diagram an example of a schematic configuration of a print apparatus to which the present invention can be applied. In order to clarify the relationships of arrangement of each of the parts of the apparatus, FIG. 1 displays an XYZ orthogonal coordinate system corresponding to the left/right direction X, the front/back direction Y, and the vertical direction Z of a print apparatus 1.

In the print apparatus 1, a feed-out part 2, a process part 3, and a take-up part 4 are arrayed in the left/right direction X, and each of these functional parts 2, 3, 4 is accommodated in an internal space IS surrounded by a housing member 11. The feed-out part 2 and the take-up part 4 include a feed-out spindle 20 and a take-up spindle 40, respectively. Two ends of a sheet S (web), serving as a recording medium, are wound in the shape of a roll around the feed-out spindle 20 and the take-up spindle 40, the sheet S being stretched therebetween. Along a path Pc in which the sheet S is stretched, the sheet S is conveyed from the feed-out spindle 20 to the process part 3, subjected to a print process by a process unit 3U, and thereafter conveyed toward the take-up spindle 40. The type of the sheet S is largely divided into paper-based and film-based. As specific examples, paper-based includes high-quality paper, cast paper, art paper, coated paper, and the like, while film-based includes synthetic paper, PET (polyethylene terephthalate), PP (polypropylene), and the like. In the following description, whichever side of the two sides of the sheet S is the one on which the image is recorded is referred to as the "(front) surface", while the side opposite thereto is referred to as the "reverse surface". Also, in the following description, instances where simply "upstream (side)" or "downstream (side)" is stated are understood to signify the upstream side or downstream side, respectively, of the direction of sheet conveyance in a sheet conveyance path.

The feed-out part 2 has the feed-out spindle 20, around which an end of the sheet S has been wound, as well as a driven roller 21 around which the sheet S having been drawn out from the feed-out spindle 20 is wound. The feed-out spindle 20 supports the end of the sheet S wound therearound in a state where the front surface of the sheet S faces outward. Clockwise rotation of the feed-out spindle 20, as seen in the plane of the paper in FIG. 1, causes the sheet S having been wound around the feed-out spindle 20 to be fed out toward the process part 3, passing by way of the driven roller 21. It should also be noted that the sheet S is wound about the feed-out spindle 20 with a core tube (not shown) therebetween, the core tube being detachable with respect to the feed-out spindle 20. As such, when the sheet S of the feed-out spindle 20 has been exhausted, it is possible for a new core tube around which a roll of the sheet S has been wound to be mounted onto the feed-out spindle 20, to replace the sheet S of the feed-out spindle 20. Though described in greater detail below, a tension sensor S21 for detecting the tension of the sheet S wound around the driven roller 21 is provided to the driven roller 21.

The process part 3 is intended to record an image onto the sheet S by carrying out a process onto the sheet S, as appropriate, using the process unit 3U arranged along the outer peripheral surface of a rotating drum 30 while the rotating drum 30 supports the sheet S having been fed out from the feed-out part 2. At this process part 3, a front drive roller 31 and a rear drive roller 32 are provided to both sides of the rotating drum 30, and the sheet S being conveyed from the front drive roller 31 toward the rear drive roller 32 is supported by the rotating drum 30 and undergoes the printing of an image.

The front drive roller 31 has on the outer peripheral surface a plurality of minute projections formed by thermal spraying, and the sheet S having been fed out from the feed-out part 2 is wound around from the reverse surface side. Also, clockwise rotation of the front drive roller 31 as seen in the plane in FIG. 1 causes the sheet S having been fed out from the feed-out part 2 to be conveyed to the downstream side in the conveyance path. Also, a nip roller 31*n* is provided for the front drive roller 31. This nip roller 31*n* abuts against the front surface of the sheet S in a state of having been urged to the front drive roller 31 side, and nips the sheet S with the front drive roller 31. This ensures the force of friction between the front drive roller 31 and the sheet S, and makes it possible for the front drive roller 31 to reliably convey the sheet S.

The rotating drum 30 is a drum of cylindrical shape that has a center line parallel to the Y-direction, and the sheet S is wound around the outer peripheral surface thereof. Also, the rotating drum 30 has a rotating shaft 302 that passes through the center line of this cylindrical shape and extends in the axial direction. The rotating shaft 302 is rotatably supported by a support mechanism (not shown), and the rotating drum 30 rotates about the rotating shaft 302.

Around the outer peripheral surface of the rotating drum 30 of such description, the sheet S being conveyed from the front drive roller 31 toward the rear drive roller 32 is wound from the reverse surface side. The rotating drum 30 supports the sheet S from the reverse surface side while also being rotatingly driven in a direction of conveyance Ds of the sheet S under the force of friction against the sheet S. Here, in the process part 3 there are provided driven rollers 33, 34 the loop the sheet S back at both sides of the part wound about the rotating drum 30. Of these, the driven roller 33 has the front surface of the sheet S wound around between the front drive roller 31 and the rotating drum 30 and loops the sheet S back. The driven roller 34, in turn, winds the front surface of the sheet S around between the rotating drum 30 and the rear drive roller 32 and loops the sheet S back. This manner of looping the sheet S back at the upstream and downstream sides in the direction of conveyance Ds relative to the rotating drum 30 makes it possible to ensure a long part of the sheet S wound around the rotating drum 30.

The rear drive roller 32 has on the outer peripheral surface a plurality of minute projections formed by thermal spraying, and the sheet S having been conveyed from the rotating drum 30 via the driven roller 34 is wound therearound from the reverse surface side. Clockwise rotation of the rear drive roller 32 as seen in the plane of FIG. 1 causes the sheet S to be conveyed toward the take-up part 4. A nip roller 32*n* is provided for the rear drive roller 32. This nip roller 32*n* abuts against the front surface of the sheet S in a state of having been urged to the rear drive roller 32 side, and nips the sheet S against the rear drive roller 32. This ensures the force of friction between the rear drive roller 32 and the sheet S, and makes it possible for the rear drive roller 32 to reliably convey the sheet S. Though described in greater detail below, a drum encoder E30 for detecting the position of rotation of the rotating drum 30 is provided thereto, and provided to the driven roller 34 is a tension sensor S34 for detecting the tension of the sheet S having been around the driven roller 34.

In this manner, the sheet S being conveyed from the front drive roller 31 to the rear drive roller 32 is supported on the outer peripheral surface of the rotating drum 30. Also, at the process part 3, the process unit 3U is provided in order to print a color image onto the front surface of the sheet S supported by the rotating drum 30. This process unit 3U is equipped with a configuration where print heads 36*a* to 36*d* and UV irradiators 37*a* to 37*c*, 38 are supported with a unit support member 35. This unit support member 35 has two unit support plates having a circular arc shape running along the circumferential shape of the rotating drum 30, and the print heads 36*a* to 36*d* and UV irradiators 37*a* to 37*c*, 38 are thereby nipped in from the front/back direction Y and supported. As illustrated in FIG. 1, a gap A is free between the (unit support plates of the) unit support member 35 and the rotating drum 30.

The four print heads 36*a* to 36*d*, which are arranged side by side in sequence in the direction of conveyance Ds, correspond to yellow, cyan, magenta, and black and discharge the ink of the corresponding color from nozzles in an inkjet format. These four print heads 36*a* to 36*d* are arranged in a radiating manner from the rotating shaft 302 of the rotating drum 30, and are arranged side by side along the outer peripheral surface of the rotating drum 30. Each of the print heads 36*a* to 36*d* is positioned relative to the rotating drum 30 by the unit support member 35, and faces the rotating drum 30 with a slight clearance (platen gap) free therebetween. This causes each of the print heads 36*a* to 36*d* to face the front surface of the sheet S wound around the rotating drum 30, while leaving a predetermined paper gap free therebetween. By discharging the ink in a state where the paper gap has been regulated by the unit support member 35 in this manner, each of the print heads 36*a* to 36*d* causes ink to land at a desired position on the front surface of the sheet S, thus forming the color image on the front surface of the sheet S.

Ultraviolet (UV) ink (photo-curable ink) that is cured by being irradiated with ultraviolet rays (light) is employed as the ink used with the print heads 36*a* to 36*d*. Therefore, at the process unit 3U, the UV irradiators 37, 38 are provided in order to cure the ink and fix the ink to the sheet S. The execution of this curing of the ink is divided into two stages, which are temporary curing and true curing. The UV irradiators 37*a* to 37*c*, which are for temporary curing, are arranged respectively between the four print heads 36*a* to 36*d*. More specifically, the first UV irradiator 37*a* is arranged at a downstream position of the first print head 36*a*, which is on the most upstream side in the direction of conveyance; the second UV irradiator 37*b* is arranged at a downstream position of the second print head 36*b*, and the third UV irradiator 37*c* is arranged at a downstream position of the third print head 36*c*. The UV irradiators 37*a* to 37*c* are intended to irradiate with ultraviolet rays of relatively low irradiation intensity and thereby cure the ink to such an extent that the ink wets and spreads sufficiently slower than when not irradiated with ultraviolet rays (that is, is intended to temporarily cure the ink), and is not intended to truly cure the ink.

In turn, the UV irradiator 38, which is for true curing, is provided to the downstream side in the direction of conveyance Ds relative to the four print heads 36*a* to 36*d*. In other words, the UV irradiator 38 is intended to irradiate with ultraviolet rays of a greater irradiation intensity than the UV irradiators 37*a* to 37*c*, and thereby cure the ink to such an extent that the wetting and spreading of the ink stops (i.e., is intended to truly cure the ink). This manner of executing the temporary curing and true curing enables affixation, onto the front surface of the sheet S, of the color image formed by the plurality of print heads 36*a* to 36*d*.

The UV irradiator 38 is equipped with a cooling function for cooling a light source for irradiating with the ultraviolet rays. This cooling mechanism cools the light source by using an air flow obtained when air is taken in from the housing member 11 exterior and air is discharged to the housing member 11 exterior. Therefore, an air intake port 51 by which the air is taken in from the exterior and an air discharge port 53 for discharging the air to the exterior are provided to the housing member 11, for the UV irradiator 38. More specifically, the air intake port 51 and the air discharge port 53 are constituted of a louver or the like that opens into the housing member 11. An air intake duct 55 leading from the air intake port 51 to the UV irradiator 38 and an air discharge duct 57 leading from the UV irradiator 38 to the air discharge port 53 are provided to the interior of the housing member 11, for the UV irradiator 38.

An air intake fan 67 is provided to the interior of the air intake duct 55 and an air discharge fan 68 is provided to the interior of the air discharge duct 57; the operation of these fans generates an air flow AF that: is intaken from the air intake port 51; passes via an air flow path Pg1 formed in the interior of the air intake duct 55, an upper end part of the UV irradiator 38, and an air flow path Pg2 formed in the interior of the air discharge duct 57; and is discharged from the air discharge port 53. Heat that is emitted from the UV irradiator 38 is discharged to outside the apparatus by this air flow AF.

In this manner, the print heads 36*a* to 36*d* and the UV irradiators 37*a* to 37*c*, 38 are mounted onto the unit support member 35, thus constituting the process unit 3U. The unit support member 35 is supported by two rails 351 extending in the front/back direction Y, and is also rendered movable in the front/back direction Y over the rails 351, accompanied by the print heads 36*a* to 36*d* and the UV irradiators 37*a* to 37*c*, 38. In other words, the process unit 3U is rendered movable in the front/back direction Y. This makes it possible for the process unit 3U to move between a print position aligned at substantially the same position as the feed-out part 2 and the take-up part 4 in the front/back direction Y and a maintenance position where the Y-direction position is significantly difference from those of the feed-out part 2 and the take-up part 4. In the state where the process unit 3U is located at the print position, it becomes possible to form the conveyance path Pc for the sheet S leading from the feed-out part 2, through the process part 3, until the take-up part 4, thus enabling the process unit 3U to print onto the sheet S. In the state where the process unit 3U is at the maintenance position, however, the process unit 3U is exposed to the outside space, and a variety of different forms of maintenance work, such as replacement of components by an operator, become possible.

The sheet S on which the color image has been formed by the process part 3 is conveyed toward the take-up part 4 by the rear drive roller 32. In addition to the take-up spindle 40 around which the end of the sheet S is wound, the take-up part 4 also has a driven roller 41 for winding the sheet S around from the reverse surface side between the take-up spindle 40 and the rear drive roller 32. The take-up spindle 40 supports one end of the sheet S taken up therearound in a state where the front surface of the sheet S is facing outward. In other words, when the take-up spindle 40 rotates clockwise in the plane of FIG. 1, then the sheet S having been conveyed from the rear drive roller 32 passes through the driven roller 41 and is taken up at the take-up spindle 40. It also should be noted that the sheet S is taken up around the take-up spindle 40 with a core tube (not shown) therebetween, the core tube being detachable with respect to the take-up spindle 40. As such, when the sheet S taken up around the take-up spindle 40 is fully stocked, it becomes possible to remove the sheet S in an amount commensurate with the core tube.

Figure 2:
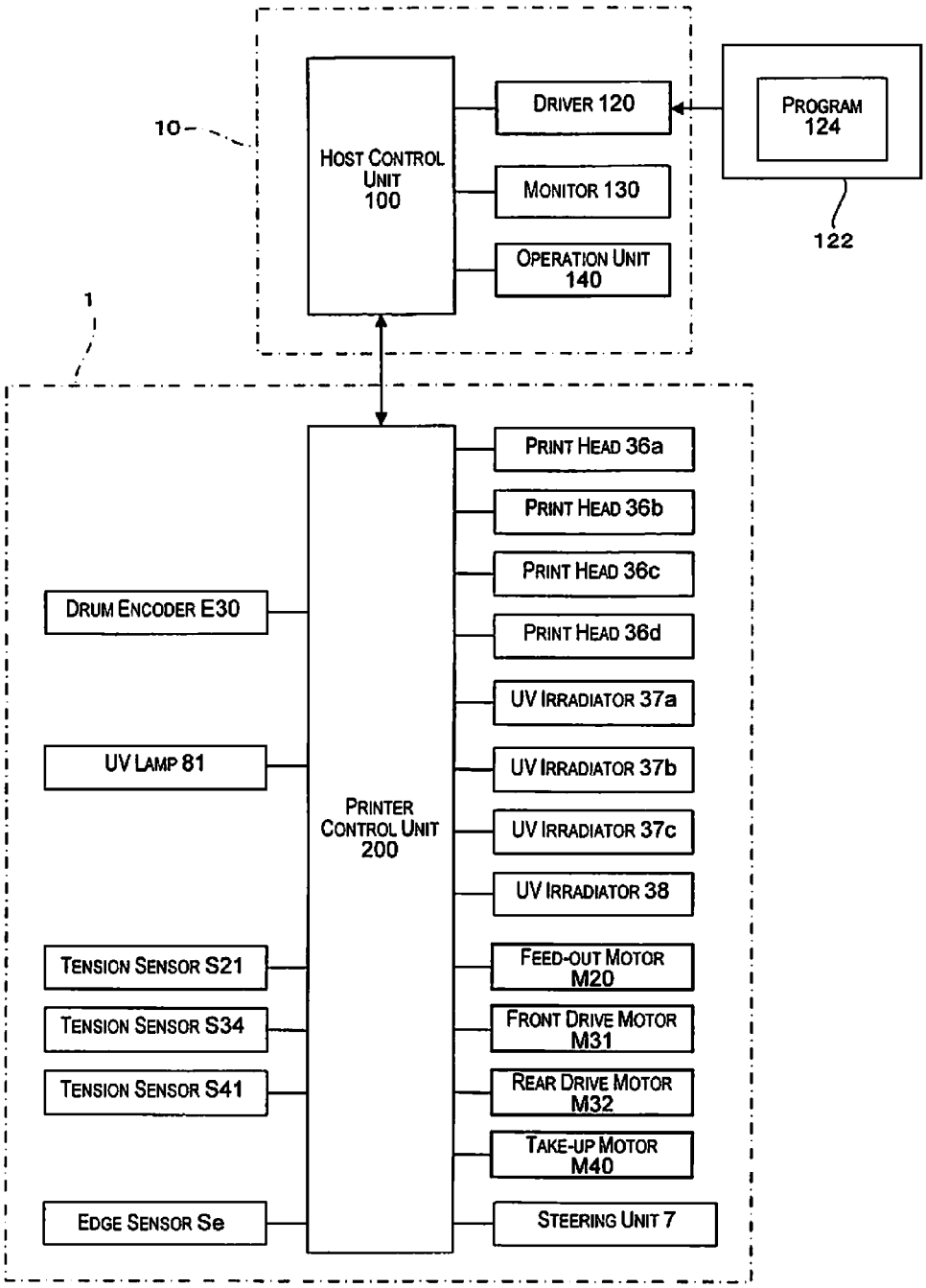
FIG. 2 is a block diagram schematically illustrating an electrical configuration for controlling the print apparatus illustrated in FIG. 1.

The above is a summary of the apparatus configuration of the print apparatus 1. The electrical configuration for controlling the print apparatus 1 shall be described next. FIG. 2 is a block diagram schematically illustrating the electrical configuration for controlling the print apparatus illustrated in FIG. 1. The operation of the print apparatus 1 described above is controlled by a host computer 10 illustrated in FIG. 2. With the host computer 10, a host control unit 100 for governing all control operations is constituted of a central processing unit (CPU) and a memory. A driver 120 is also provided to the host computer 10, and this driver 120 reads out a program 124 from media 122. The media 122 can be a variety of different things, such as a CD (Compact Disk), DVD (Digital Versatile Disk), or USB (Universal Serial Bus) memory. The host control unit 100 controls each of the parts of the host computer 10 and controls the operation of the print apparatus 1 on the basis of the program 125 that is read out from the media 122.

A monitor 130 constituted of a liquid crystal display or the like and an operation unit 140 constituted of a keyboard, mouse, or the like are provided to the host computer 10 as interfaces for interfacing with an operator. In addition to an image to be printed, a menu screen is also displayed on the monitor 130. As such, by operating the operation unit 140 while also checking the monitor 130, the operator is able to open up a print setting screen from the menu screen and set the type of printing medium, the size of printing medium, the quality of printing, and a variety of other print conditions. A variety of modifications could be made to the specific configuration of the interface for interfacing with the operator; for example, a touch panel-type display may be used as the monitor 130, the operation unit 140 being then constituted of the touch panel of this monitor 130.

In turn, provided in the print apparatus 1 is a printer control unit 200 for controlling each of the parts of the print apparatus 1 in accordance with a command coming from the host computer 10. The print heads, the UV irradiators 37*a* to 37*c*, 38, and each of the apparatus parts of the sheet conveyance system are then controlled by the printer control unit 200. The details of the manner in which the printer control unit 200 controls each of the apparatus parts are as follows.

The printer control unit 200 controls, in accordance with the conveyance of the sheet S, the ink discharge timing for each of the print heads 36*a* to 36*d* for forming the color image. More specifically, the control of the ink discharge timing is executed on the basis of the output (detection value) of the drum encoder E30 that is attached to a rotating shaft of the rotating drum 30 and detects the position of rotation of the rotating drum 30. In other words, because the rotating drum 30 is rotatingly driven in association with the conveyance of the sheet S, it is possible to ascertain the position of conveyance of the sheet S when the output of the drum encoder E30 for detecting the position of rotation of the rotating drum 30 is consulted. Therefore, the printer control unit 200 generates a print timing signal (pts) from the output of the drum encoder E30, controls the ink discharge timing of each of the print heads 36*a* to 36*d* on the basis of this pts, and thereby causes the ink discharged by each of the print heads 36*a* to 36*d* to land on a target position of the sheet S being conveyed, thus forming the color image.

Also controlled by the printer control unit 200 are the timing for turning the UV irradiators 37*a* to 37*c*, 38 on and off and the irradiation light intensities thereof.

The printer control unit 200 also governs a function for controlling the conveyance of the sheet S, as described in detail with reference to FIG. 1. In other words, among the members constituting the sheet conveyance system, a motor is respectively connected to the feed-out spindle 20, the front drive roller 31, the rear drive roller 32, and the take-up spindle 40. The printer control unit 200 controls the speed and torque of each of the motors while causing the motors to rotate, and thus controls the conveyance of the sheet S. The details of this control of the conveyance of the sheet S are as follows.

The printer control unit 200 causes a feed-out motor M20 for driving the feed-out spindle 20 to rotate, and supplies the sheet S from the feed-out spindle 20 to the front drive roller 31. At this time, the printer control unit 200 controls the torque of the feed-out motor M20 and adjusts the tension of the sheet S from the feed-out spindle 20 to the front drive roller 31. Namely, the tension sensor S21 for detecting the tension of the sheet S wound around the driven roller 21 is attached to the driven roller 21, which is arranged between the feed-out spindle 20 and the front drive roller 31. The tension sensor S21 can be constituted of, for example, a load cell for detecting the force received from the sheet S. Then, the printer control unit 200 implements feedback control of the torque of the feed-out motor M20 on the basis of the result of detection of the tension sensor S21, and adjusts the tension imparted to the sheet S being supplied from the feed-out part 2.

The printer control unit 200 herein feeds the sheet S out while also adjusting the position, in the width direction (the direction orthogonal to the paper in FIG. 1), of the sheet S being fed out from the feed-out spindle 20 to the front drive roller 31. Namely, provided to the print apparatus 1 is a steering unit 7 for respectively displacing the feed-out spindle 20 and the driven roller 21 in the axial direction (in other words, the width direction of the sheet S). An edge sensor Se for detecting an end of the sheet S in the width direction is arranged between the driven roller 21 and the front drive roller 31. The edge sensor Se can be constituted of a distance sensor such as, for example, an ultrasonic sensor. The printer control unit 200 also carries out feedback control of the steering unit 7 on the basis of a result of direction of the edge sensor Se, and adjusts the position of the sheet S in the width direction. The position of the sheet S in the width direction is thereby suitably adapted, and meandering or other instances of poor conveyance of the sheet S is thereby suppressed.

The printer control unit 200 also rotates a front drive motor M31 for driving the front drive roller 31, and a rear drive motor M32 for driving the rear drive roller 32. The sheet S having been fed out from the feed-out part 2 is thereby passed through the process part 3. Herein, speed control is executed for the front drive motor M31, whereas torque control is executed for the rear drive motor M32. In other words, the printer control unit 200 adjusts the rotational speed of the front drive motor M31 to a constant speed, on the basis of an encoder output for the front drive motor M31. The sheet S is thereby conveyed at a constant speed by the front drive roller 31.

In turn, the printer control unit 200 controls the torque of the rear drive motor M32 and adjusts the tension of the sheet S from the front drive roller 31 until the rear drive roller 32. Namely, attached to a driven roller 34 arranged between the rotating drum 30 and the rear drive roller 32 is a tension sensor S34 for detecting the tension of the sheet S wound around the driven roller 34. This tension sensor S34 can be constituted, for example, of a load cell for detecting the force received from the sheet S. The printer control unit 200 carries out feedback control of the torque of the rear drive motor M32 and adjusts the tension imparted to the sheet S on the basis of a result of detection of the tension sensor S34.

The printer control unit 200 causes a take-up motor M40 for driving the take-up spindle 40 to rotate, and the sheet S conveyed by the rear drive roller 32 is taken up around the take-up spindle 40. Here, the printer control unit 200 controls the torque of the take-up motor M40 and adjusts the tension of the sheet S from the rear drive roller 32 until the take-up spindle 40. Namely, attached to the driven roller 41 arranged between the rear drive roller 32 and the take-up spindle 40 is a tension sensor S41 for detecting the tension of the sheet S wound around the driven roller 41. This tension sensor S41 can be constituted, for example, of a load cell for detecting the force received from the sheet S. The printer control unit 200 carries out feedback control of the torque of the take-up motor M40 and adjusts the tension imparted to the sheet S on the basis of a result of detection of the tension sensor S41.

In the configuration of the sheet conveyance system described above, with respect to the sheet S that is wound around the rotating drum 30 and receives the print process from the process unit 3U, the control of the rotation of the rear drive roller 32 on the basis of the result of detection of the tension sensor S34 associated with the driven roller 34 makes it possible to perform a stable print process with the tension thereof maintained constant.

In turn, with respect to the sheet S being conveyed from the feed-out part 2 to the process part 3, the performance of the position control for the feed-out spindle 20 and the driven roller 21 on the basis of the result of detection of the tension sensor S21 associated with the driven roller 21 prevents the sheet S from experiencing excessive or inadequate supply or slackening. Also, with respect to the sheet S being carried out from the process part 3 to the take-up part, the control of the rotation of the take-up spindle 40 on the basis of the result of detection of the tension sensor S41 associated with the driven roller 41 prevents the sheet S from experiencing excessive or inadequate take-up or slackening.

The above is a summary of the electrical configuration for controlling the print apparatus 1. As has been described above, the front drive roller 31 rotates at a predetermined speed and the sheet S is thereby conveyed along the conveyance pathway Pc at a constant speed. The printer control unit 200 in this manner controls the conveyance speed of the sheet S to a constant speed, and thereupon adjusts the tension being applied to the sheet S.

The description returns now to FIG. 1 and further addresses the configuration of the print apparatus 1. An external light irradiation unit 8 can be mounted as an option unit to the print apparatus 1 configured as described above. This light irradiation unit 8 is for irradiating the sheet S with UV light at a greater exposure amount than the total exposure amount of light irradiated within the print apparatus 1 (the time-integrated value of the amounts of irradiation by each of the UV irradiators 37*a* to 37*c*, 38). With respect to the UV irradiators 37*a* to 37*c*, 38 included in the process unit 3U, preferably, UV irradiators for which the light source is a light-emitting diode (LED) having a relatively small amount of heat generated are used, in order to suppress any rise in temperature of the unit. Depending on the properties of the photo-curable ink and the sheet S, such UV irradiators where an LED is the light source alone could in some instances fail to provide an adequate amount of exposure to cure the ink to the required hardness.

To address such a situation, the print apparatus 1 is configured so that the external light irradiation unit 8 can be attached as needed in order to make it possible to more reliably cure the ink. As illustrated in FIG. 1, the light irradiation unit 8 is provided with: a plurality of driven rollers 801 to 806 for forming an external conveyance path Px by being rotatingly driven with the sheet S, having passed through the driven roller 41, wrapped therearound; and a UV lamp 81 of irradiating the sheet S being conveyed through the external conveyance path Px with ultraviolet rays. The sheet S, having been conveyed through the external conveyance path Px and irradiated with ultraviolet rays, is returned to the print apparatus 1 main body and taken up by the take-up spindle 40.

The roller 801, which, of the driven rollers 801 to 804, is provided to the most upstream side in the direction of sheet conveyance, i.e., to the nearest position of the driven roller 41 on the main body side, is a posture-maintaining roller for maintaining the posture of the sheet S wound around the driven roller 41 to substantially the same posture as the case where the light irradiation unit 8 is not mounted. That is, the posture-maintaining roller 801 is arranged to a position near the path of the sheet S going toward the take-up spindle 40 from the driven roller 41 in a state where the light irradiation unit 8 is not mounted. This makes it possible to prevent the mounting of the light irradiation unit 8 or lack thereof from significantly changing the amount of winding of the sheet S around the driven roller 41, and possible to curb any fluctuation in the detection accuracy from the tension sensor S41 associated with the driven roller 41.

The UV lamp 81 is one that has a lamp light source, such as, for example, a high-pressure mercury lamp, a low-pressure mercury lamp, or a metal halide lamp, and supplies to the sheet S an amount of light exposure greater than the UV irradiators 37*a* to 37*c*, 38, for which the light source is an LED. More specifically, in a wavelength component effective for curing the photo-curable ink, the UV lamp 81 has a greater amount of light exposure by which the sheet S is exposed than the sum of the amounts of light of exposure by which the UV irradiators 37*a* to 37*c*, 38 expose the sheet S. Therefore, the photo-curable ink adhering to the sheet S can be more reliably cured. The turning on and off of the UV lamp 81 is controlled by the printer control unit 200, but may also be controlled by a control unit provided to the light irradiation unit 8 independently thereof.

Figure 3A:
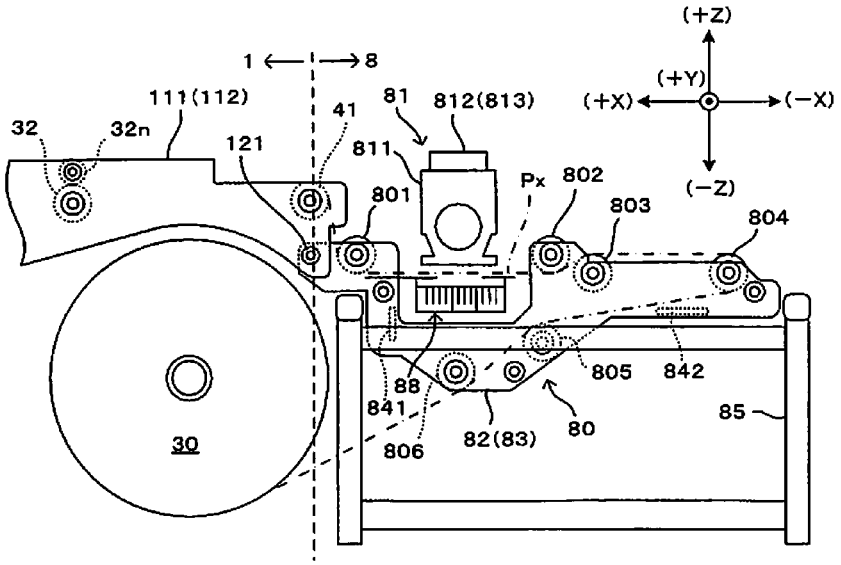
FIG. 3A is a drawing for illustrating the mechanical configuration of a light irradiation unit in greater detail.
Figure 3B:
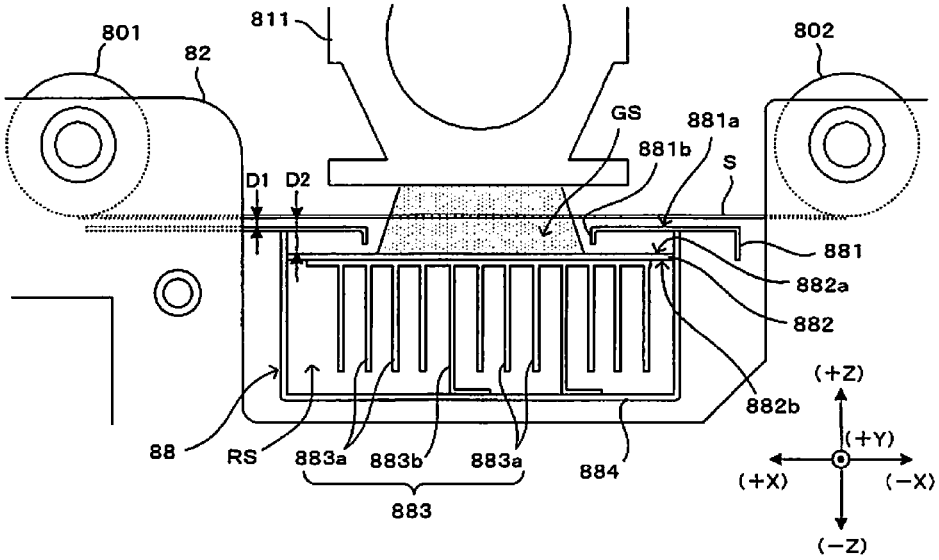
FIG. 3B is a drawing for illustrating the mechanical configuration of the light irradiation unit in greater detail.
Figure 4:
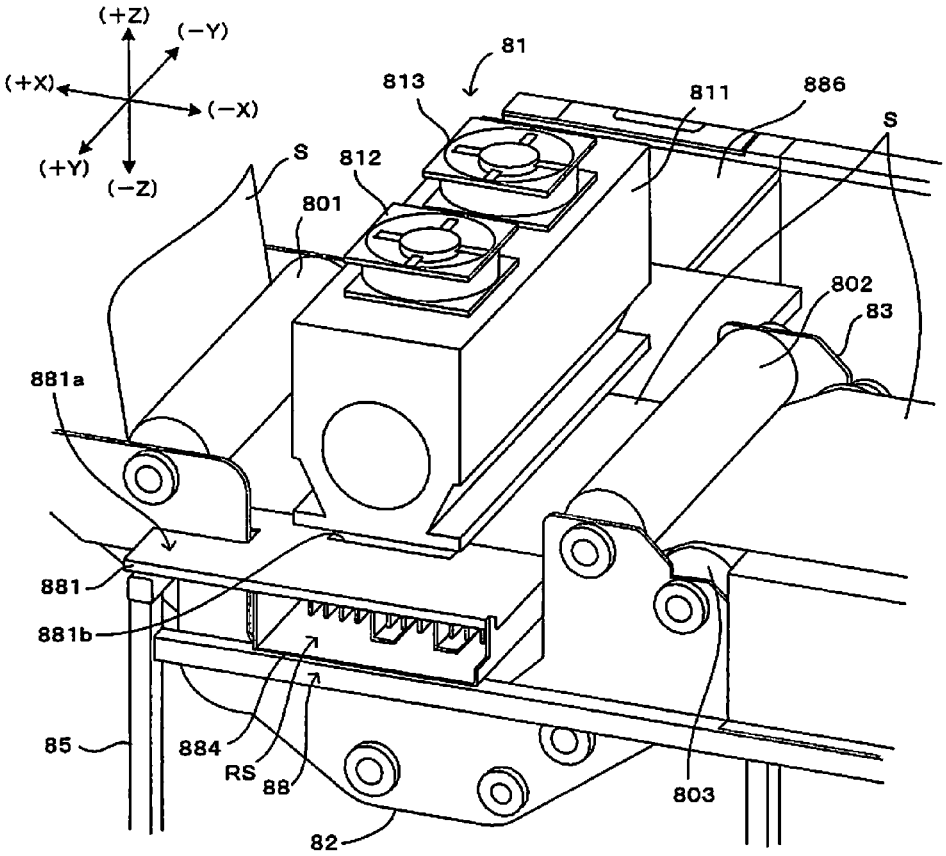
FIG. 4 is an external perspective view of a light irradiation unit principal part.
Figure 5:
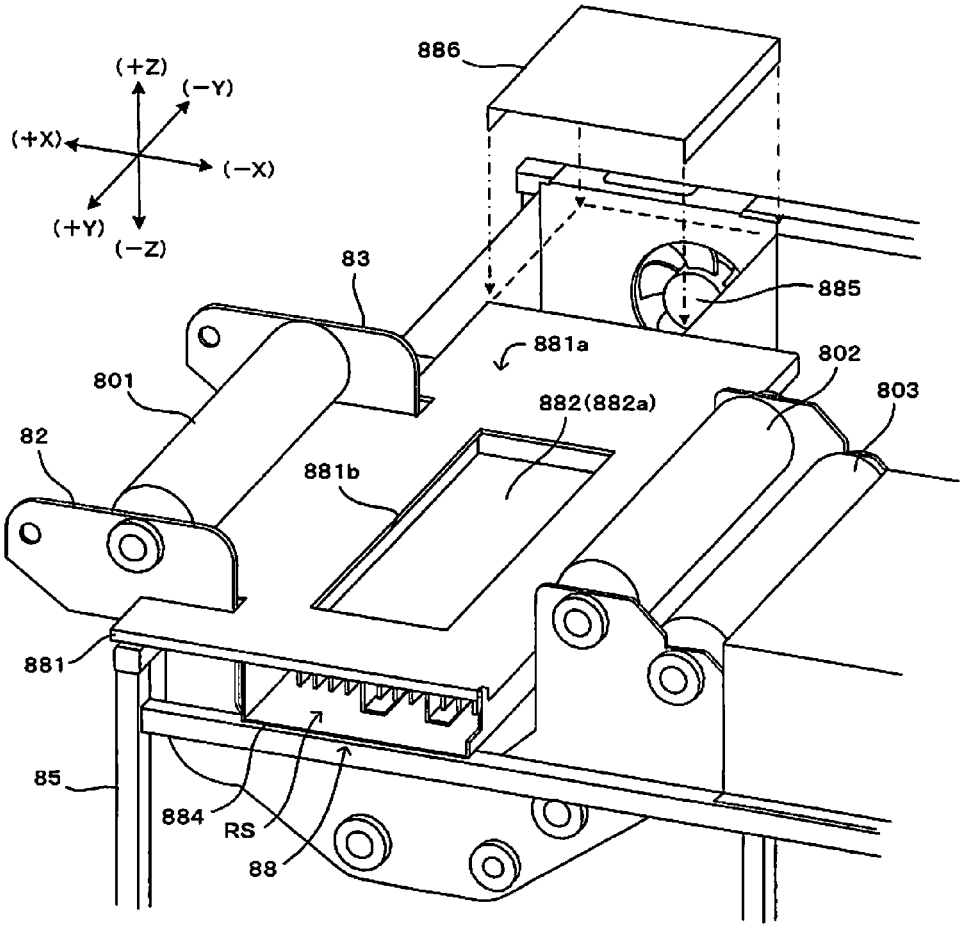
FIG. 5 is a perspective view illustrating the external appearance of the light irradiation unit principal part, less a UV lamp and a sheet.

FIGS. 3A and 3B are drawings for illustrating the mechanical configuration of a light irradiation unit in greater detail. More specifically, FIG. 3A is a side view illustrating the outer appearance of the light irradiation unit 8, and FIG. 3B is a partial enlarged view thereof. In FIG. 3A, the external conveyance path Px for the sheet S is illustrated by the one-dot chain line. FIG. 4 is an external perspective view of a light irradiation unit principal part, and FIG. 5 is a perspective view illustrating the outer appearance of the light irradiation unit principal part, less a UV lamp and a sheet.

The UV lamp 81 is provided with a lamp light source 811 that generates intense UV light and has a direction of emission that is regulated downward (the –Z-direction), and cooling fans 812, 813 that are mounted onto an upper part of the lamp light source 811 in order to cool same. Though a depiction has been omitted in order to clearly show the structure of the sheet conveyance system, there is also provided, as appropriate, a support mechanism for supporting the UV lamp 81, the support mechanism facing the front surface of the sheet S being conveyed through the external conveyance path Px.

The light irradiation unit 8 has a support frame 80 for supporting each of the rollers 801 to 806 so as to be rotatable about a rotating axis parallel to the Y-axis; the support frame 80 is provided with: a pair of plate members 82, 83 that are formed of, for example, iron plates so as to have symmetrical shapes reaching a relationship of mirror images with one another with respect to the XZ-plane, and are arranged in parallel so as to be separated in the Y-direction; and coupling members 841, 842 that extend in the Y-direction and couple and integrate the plate members 82, 83 to one another. The support frame 80, integrated in this manner, is placed over a mount 85 that is disposed below, while rotatably supporting the rollers 801 to 806. The mount 85 has the function of supporting from below the support frame coupled as described above when the light irradiation unit 8 is separated from the print apparatus 1.

The support frame 80 is coupled to the print apparatus 1 main body at a (+X)side end part thereof. More specifically, as illustrated in FIG. 3A, a print apparatus 1-side roller member, specifically, the rear drive roller 32, the drive roller 41, or the like is rotatably supported by a pair of plate members 111, 112 forming one part of the housing member 11, formed so as to be symmetrical, similarly with respect to each of the light irradiation unit 8-side rollers. The light irradiation unit 8-side plate member 82 and the print apparatus 1 main body-side plate member 111 are coupled by a coupling pin 121. Likewise, the light irradiation unit 8-side plate member 83 and the print apparatus 1 main body-side plate member 112 are coupled by a coupling pin (not shown).

In a print system where the print apparatus 1 and the light irradiation unit 8 have been coupled in this manner, then the sheet S having been drawn out from the print apparatus 1 is passed over each of the rollers 801 to 806 inside the light irradiation unit 8 and ultimately returned to the take-up spindle 40 of the print apparatus 1. A backup part 88 is provided to the reverse surface side of the sheet S at a position where the front surface side faces the UV lamp 81, out of the sheet S being conveyed along the external conveyance path Px thus formed.

The backup part 88 is close to and faces but is not in contact with the sheet S when the sheet S is being properly conveyed along the external conveyance path Px. In a case where the sheet S being conveyed experiences bending or waving, however, then the backup part 88 comes into contact with the reverse surface of the sheet S and regulates movement of the sheet S in the direction of drawing away from the UV lamp 81. This prevents the sheet S from deviating greatly from the conveyance path, and prevents the occurrence of insufficient irradiation caused by an increase in the distance between the sheet S and the UV lamp 81.

When the light irradiation unit 8 is mounted onto the print apparatus 1 or the sheet S is being replaced and a sheet S is newly wound around the roller 801 or the like, then the backup part 88 assists the operator with the task by supporting the reverse surface of the sheet S and maintaining the posture thereof. The backup part 88 also has the function of preventing the sheet S from bending greatly when the conveyance of the sheet S is stopped.

The backup part 88 receives the light irradiation and heat radiation coming from the UV lamp 81. Likewise receiving the light irradiation and heat radiation coming from the UV lamp 81, the sheet S is conveyed and moves serially but the backup part 88 does not move, and therefore it would be possible for heat to accumulate and the temperature to rise, thus further warming the sheet S passing through the facing position.

To avoid this problem, the following two strategies have been adopted with the light irradiation unit 8. First, enacting a state where the backup part 88 serves as a two-stage staging structure and a light-receiving surface that receives light irradiation coming from the UV lamp 81 is rescued from the sheet S curbs the transfer of heat from the light-receiving surface to the sheet S. Secondly, providing heat dissipation fins to the reverse surface side of the light-receiving surface and using a cooling fan for air supply causes the heat energy received by the light-receiving surface to be rapidly released. The structure of the backup part 88 that makes this possible shall be described in greater detail below.

As illustrated in FIGS. 3B and 4, the backup part 88 has a main stage 881 that faces, spaced apart by a predetermined gap, the reverse surface of the sheet S, i.e., the surface on the opposite side to the front surface that undergoes the recording of the image and is irradiated with the light coming from the UV lamp 81. In a case where bending or the like causes the sheet S to attempt to move in the direction of drawing away from the UV lamp 81, then the reverse surface of the sheet S comes into contact with an upper surface of the main stage 881, and the movement thereof is regulated thereby. Namely, a surface 881 a of the main stage 881 that is oriented toward the sheet S has a function as a regulating surface for regulating the movement of the sheet S. The main stage 881 is formed of, for example, an iron plate.

As illustrated in FIGS. 3B and 5, an opening 881 b is provided to a middle part of the main stage 881 and more specifically to a position relative to which the UV lamp 81 is provided on the opposite side from the sheet S. The opening size of the opening 881*b* is set so that substantially all of the light that is emitted from the UV lamp 81 is incident inside the opening 881*b* when the sheet S is absent. The region marked with dots in FIG. 3B illustrates a schematic of an irradiation range of the light coming from the UV lamp 81. The outside of the irradiation range depicted is actually also irradiated with the light, but this light is of such a level as to have substantially no impact, and therefore, such light is not included in the region marked with dots in FIG. 3B. As such, the light that is emitted from the UV lamp 81 is substantially not directly incident on the regulating surface 881 a of the main stage 881.

A sub-stage 882 is in turn provided to the inside of the opening 881*b*. More specifically, the sub-stage 882 is a planar member having a greater plan size than the opening size of the main stage 881, and a front surface 882*a* thereof is provided so as to look out on the sheet S with the opening 881*b* on the other side. The sub-stage 882 is provided to a position further retracted than the main stage 881 relative to the sheet S, and a distance D2 between the sheet S and the front surface 882*a* of the sub-stage 882 is greater than a distance D1 between the sheet S being conveyed along the external conveyance path Px and a front surface (the regulating surface) 881 a of the main stage 881.

The light that is emitted from the UV lamp 81 is directly incident on the front surface 882*a* of the sub-stage 882. In other words, the front surface 882*a* has a function as a light-receiving surface for receiving light coming from the UV lamp 81. Therefore, though the temperature of the sub-stage 882 rises, the posture of the sheet S is regulated by the main stage 881 and moreover the sub-stage 882 is arranged at a position further retracted from the sheet S than the main stage 881, and therefore the approach of the sheet S to the light-receiving surface 882*a* is prevented and the transfer of heat from the warmed sub-stage 882 to the sheet S is curbed. This manner of having the backup part 88 be a two-stage structure of the main stage 881 and the sub-stage 882 and of arriving at a configuration where the light is incident on the sub-stage 882 that is separated from the sheet S reduces the transfer of heat from the warmed backup part 88 and curbs any rise in temperature of the sheet S.

Also, the front surface of the sub-stage 882, i.e., the light-receiving surface 882*a* preferably has undergone a surface treatment for suppressing the reflection of incident light and heat. For example, preferably, the surface has been roughened, colored black, or the like.

Further provided is a configuration for quickly dissipating heat received by the light-receiving surface 882*a* of the sub-stage 882. More specifically, a plurality of heat dissipation fins 883 (883*a*, 883*b*) extending in the Y-direction are erected in, in a direction perpendicular to the light-receiving surface 882*a*, at the reverse surface 882*b* on the opposite side to the light-receiving surface 882*a* of the sub-stage 882. The sub-stage 882 and the heat dissipation fins 883*a* are both formed of a material (e.g., a metal such as aluminum or copper) that has a higher thermal conductivity than that of iron, the material of the main stage 881. As such, the heat caused by the light incident on the sub-stage 882 is dissipated via the heat dissipation fins 883 from the sub-stage 882 to a surrounding space substantially isolated from a gap space GS between the sub-stage 882 and the sheet S. Any rise in temperature of the sub-stage 882 is thereby suppressed.

As illustrated in FIG. 3B, the heat dissipation fins 883 are surrounded on the +X-side, the −Z-side, and the −X-side by a channel member 884 extending in the Y-direction; the channel member 884 surrounds the heat dissipation fins 883 along with the sub-stage 882. An upper end, i.e., the +Z-side end part of the channel member 884 is attached to a lower surface of the main stage 881. The channel member 884 is constituted of a material (e.g., an iron plate) of lower thermal conductivity those of the sub-stage 882 and the heat dissipation fins 883.

The heat dissipation fins 883*b* of one part extend further downward, i.e., to the −Z-side than the other heat dissipation fins 883*a*, and a lower end thereof reaches as far as an inner bottom surface of the channel member 884; here, the heat dissipation fins 883*b* and the channel member 884 are fixed together. The +X-side and −X-side end surfaces of the sub-stage 882, meanwhile, are in contact with but are not fixed to an inside wall surface of the channel member 884. In other words, the sub-stage 882 is supported by the channel member 884 via the heat dissipation fins 883*b*.

The configuration of such description arrives at a structure where the heat dissipation fins 883 is exposed to an internal space RS surrounded by the sub-stage 882 and the channel member 884, and this internal space RS functions as a heat dissipation space to which heat coming from the heat dissipation fins 883 is released. The sub-stage 882 and the channel member 884 surround the heat dissipation space RS in a tubular shape from the X-direction and the Z-direction, thereby forming an air flow path that runs along the Y-direction; when an air flow is formed here, then the effect of heat radiation from the heat dissipation fins 883 is further enhanced. Provided for this purpose is a cooling fan 885 for circulating air to the air flow path formed by the sub-stage 882 and the channel member 884.

Figure 6:
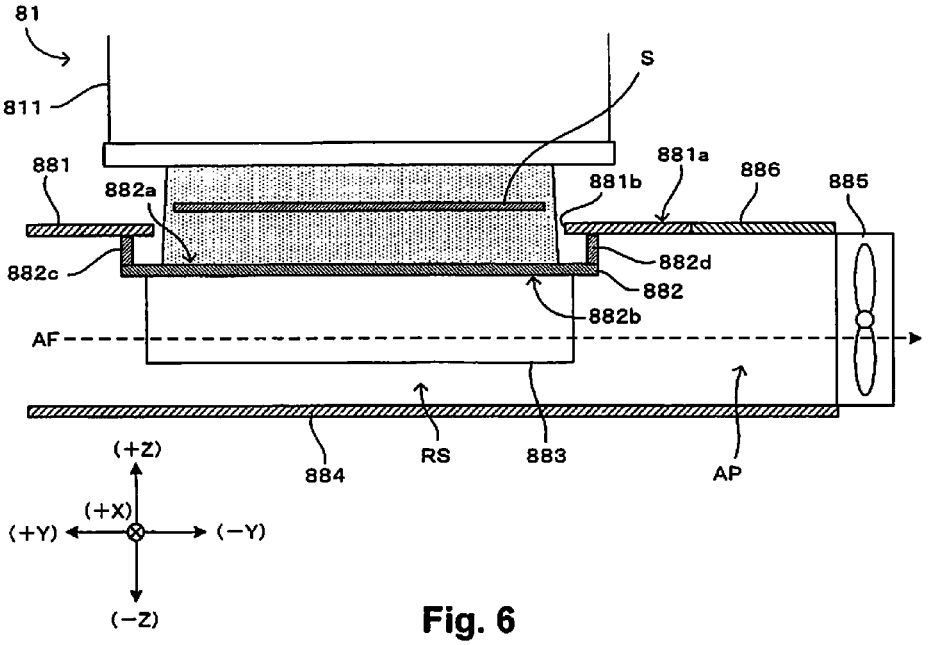
FIG. 6 is a diagram schematically illustrating the positional relationship between an air flow path and a cooling fan.

FIG. 6 is a drawing schematically illustrating the positional relationship between the air flow path and the cooling fan. As illustrated in FIGS. 5 and 6, the cooling fan 885 is provided to the −Y-side of the heat dissipation space RS surrounded by the sub-stage 882 and the channel member 884. The channel member 884 extends longer in the −Y-direction and +Y-direction each than the sub-stage 882, and along with the main stage 881 extends the heat dissipation space RS in the Y-direction. From the −Y-side end part of the main stage 881 to the cooling fan 885, the upper part of the air flow path is covered by a cover member 886.

In this manner, the heat dissipation space RS is extended in the Y-direction, and an air flow path AP leading from the +Y-side end part of the main stage 881 to the cooling fan 885 is formed. In other words, each of the members, such as the main stage 881, the sub-stage 882, the channel member 884, and the cover member 886, has also a function for forming the air flow path AP through which passes an air flow for transferring the heat of the heat dissipation space RS to the exterior.

When the cooling fan 885 is activated, then an air flow AF going from the +Y-side of the air flow path to the −Y-side is generated inside the air flow path AP. The air that has been warmed by the heat coming from the heat dissipation fins 883 while in the heat dissipation space RS is sent out to the exterior by the air flow AF, and continuous supply of lower-temperature outside air to the heat dissipation fins 883 causes the heat of the heat dissipation fins 883 to be discharged and makes it possible to efficiently cool the sub-stage 882.

Furthermore, as illustrated in FIG. 6, closing-off members 882*c*, 882*d* for closing off the gap with the lower surface of the main stage 881 are provided to the +Y-side and −Y-side end parts, respectively, of the sub-stage 882. Therefore, the sheet S being conveyed through the +Z-side beyond the main stage 881 and the sub-stage 882 is isolated from the heat dissipation space RS and the air flow path AP, and is also not impacted by the air flow AF generated by the cooling fan 885. Here, regarding the isolation of the sheet S from the heat dissipation space RS and the air flow path, it is not that the space needs to be completely isolated, but rather it is that the air flow needs to flow into the periphery of the sheet S at only a negligible level, as does the heated air inside the heat dissipation space RS and the air flow path AP.

When the air warmed from the heat dissipation space RS goes around the periphery of the sheet S, then the sheet S ends up being warmed thereby. This problem is avoided by the fact that the sheet S is isolated from the heat dissipation space RS by the main stage 881 and the sub-stage 882. There is also a concern that the sheet S could vibrate, which would interfere with conveyance, when the air flow flows through the periphery of the sheet S. This problem is also avoided by the fact that the air flow path AP is formed so that the air flow will not reach the periphery of the sheet S.

The amount of heat transferred to the main stage 881 via the channel member 884 from the sub-stage 882 and the heat dissipation fins 883 is also reduced, thus curbing any rise in temperature of the main stage 881, because of the fact that the sub-stage 882 and the heat dissipation fins 883 are formed of a material of higher thermal conductivity (e.g., aluminum) whereas the main stage 881 and the channel member 884 are formed of a material of lower thermal conductivity (e.g., iron). Because the sub-stage 882 is not fixed to the side wall surface of the channel member 884, the transfer of heat at this portion is also curbed.

Regarding the heat dissipation fins 883*b*, which are provided to the heat dissipation space RS and connect the sub-stage 882 and the channel member 884 together, it is preferable in terms of the cooling effect of the sub-stage 882 for the material to be of higher thermal conductivity, but from the perspective of reducing the transfer of heat to the channel member 884, it is preferable for the material to be of lower thermal conductivity. In a case where it is possible for the user to touch the channel member 884, however, it is desirable for the channel member 884 to be made a simple prop composed of a made of a material of lower thermal conductivity (e.g., iron) for which no heat dissipation effect is expected, to curb any rise in temperature of the channel member 884.

Figure 7:
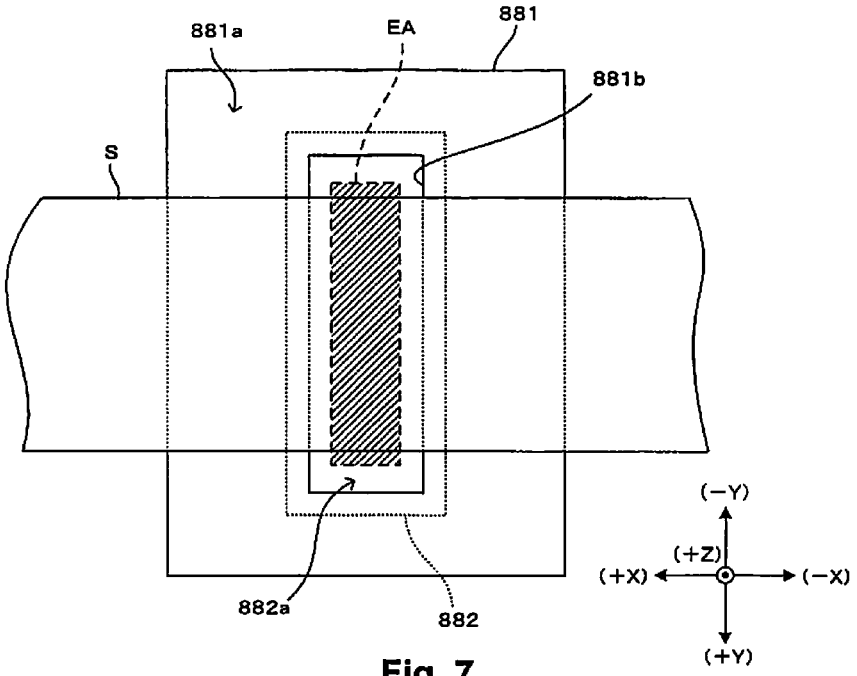
FIG. 7 is a drawing for describing the size of an opening provided to a main stage.

FIG. 7 is a drawing for describing the size of the opening provided to the main stage. First, in light of the function of backing up the sheet S, the Y-direction length of the main stage 881 needs to be greater than the width of the sheet S, i.e., than the Y-direction length of the sheet S. Next, in light of the need for the sheet S to be uniformly irradiated with light, the irradiation area EA irradiated with the light coming from the UV lamp 81 must cover the entire sheet S in the width direction, i.e. Y-direction of the sheet S. Here, in the case of a print apparatus able to print on sheets S of a variety of different widths, the Y-direction length of the irradiation area EA must be greater than the width of the widest of these sheets S.

The length of the irradiation area EA in the X-direction, meanwhile, is set with the light intensity of the irradiated light coming from the UV lamp 81 in mind, so that the amount of exposure for the sheet S, i.e., the integral value of light intensity and irradiation time reaches a predetermined value. A higher light intensity means that the irradiation time may be shorter, and therefore the length of the irradiation area EA in the X-direction is shorter. It is thus possible to set the dimensions of the irradiation area EA in accordance with the width of the sheet S and the required amount of exposure.

Thus, the opening 881*b* provided to the main stage 881 must be provided so that all of the light that is directly incident from the UV lamp 81 is guided to the interior of the opening 881 b, i.e., so that the opening surface of the opening 881 b comprises the entirety of the irradiation area EA. As such, the opening size thereof is the size of the irradiation area EA or greater. Having the size of the light-receiving surface 882*a* of the sub-stage 882 that receives the light that has passed through the opening 881*b* be greater than the size of the irradiation area EA, as well, would make it possible for the incident light to be reliably received.

Arriving at such a dimensional relationship prevents the light coming from the UV lamp 81 from being directly incident on the front surface (regulating surface) 881*a* of the main stage 881 and stops the problem where the light coming from the UV lamp 81 warms the regulating surface 881 a, raises the temperature thereof, and heats the sheet S. Because the sub-stage 882 receiving the light is separated from the sheet S and radiates heat at the opposite side to the sheet S, the temperature of the sheet S is effectively prevented from rising due to the transfer of heat from the sub-stage 882.

As a comparative example that considers a case where the opening were not to be provided to the main stage 881, the regulating surface 881*a* of the main stage 881 would be directly irradiated with a part of the irradiation light coming from the UV lamp 81. The sheet S is conveyed and serially moved and therefore is irradiated for only a brief period of time, whereas the main stage 881, which does not move, is continuously irradiated with light, and therefore the temperature of the main stage 881 does rise. In particular in a case where the width of the sheet S is small, the irradiated surface area of the main stage 881 is even greater, and the rise in temperature, too, becomes more remarkable. Therefore, the sheet S would be warmed by the main stage 881, adversely affecting the print process.

In the present embodiment, regardless of the width of the sheet S, the irradiation light passes through the opening 881*b* of the main stage 881 and is incident on the sub-stage 882, and the sub-stage 882 is being cooled at all times, and therefore the rise in temperature of the main stage 881 is extremely limited.

As described above, in the present embodiment, the opening 881*b* is provided to the main stage 881 for backing up the sheet S, and the light emitted from the UV lamp 81 is incident on this opening 881*b*. In other words, the direction of emission of light from the UV lamp 81 is regulated so that the entirety of the emitted light is oriented towards inside the opening 881*b*. Therefore, a part of the light that does not hit against the sheet S is incident on the opening 881*b*. For this reason, the rise in temperature of the main stage 881 caused by the light irradiation is suppressed, and the problem where the main stage 881 heats the sheet S is avoided.

The light that passes through the opening 881 b is incident on the sub-stage 882. The sub-stage 882 is warmed thereby, but because the distance from the sheet S is greater than the main stage 881, the action of heating the sheet S is limited, and the rise in temperature of the sub-stage 882 itself is also suppressed because the heat is radiated at the opposite side to the surface oriented toward the sheet S. In particular, providing the heat dissipation fins 883 to the sub-stage 882 further enhances the heat dissipation effect. Forming the sub-stage 882 and the heat dissipation fins 883 of a material (e.g., aluminum) of higher thermal conductivity than, for example, iron, which is the material of the main stage 881, makes it possible to further reduce the transfer of heat to the main stage 881.

Providing the cooling fan 885, supplying the lower-temperature outside air to the heat dissipation fins 883, and generating an air flow that discharges the warmed air out also further enhances the heat dissipation effect. Problems such as where warmed air goes around the periphery of the sheet S or where the sheet S vibrates due to the influence of the air flow are avoided by the fact that the flow path for the air flow is limited to the area surrounded by the main stage 881, the sub-stage 882, the channel member 884, and the like and isolated from the path of conveyance for the sheet S.

Also, a lamp light source is used as the UV light source, and though the amount of heat generated thereby is large, the heat radiated as described above is effectively dissipated, and therefore it is possible to curb the impact of heat on the sheet S and irradiate the sheet S with the powerful light coming from the lamp light source.

The following can be considered by way of example as modification examples with which an effect similar to that of the above-described configuration is obtained. In the modification examples that follow, the description centers on portions that differ from the above-described embodiment, and configurations identical to the above description are either omitted from mention or are given the same reference numeral with an omission of any description thereof. However, unless otherwise specified, each of the configurations belonging to the above-described embodiment are understood to be similarly provided to each of the following modification examples as well, and the actions and effects exerted thereby are also understood to have been maintained in each of the modification examples as well.

Figure 8A:
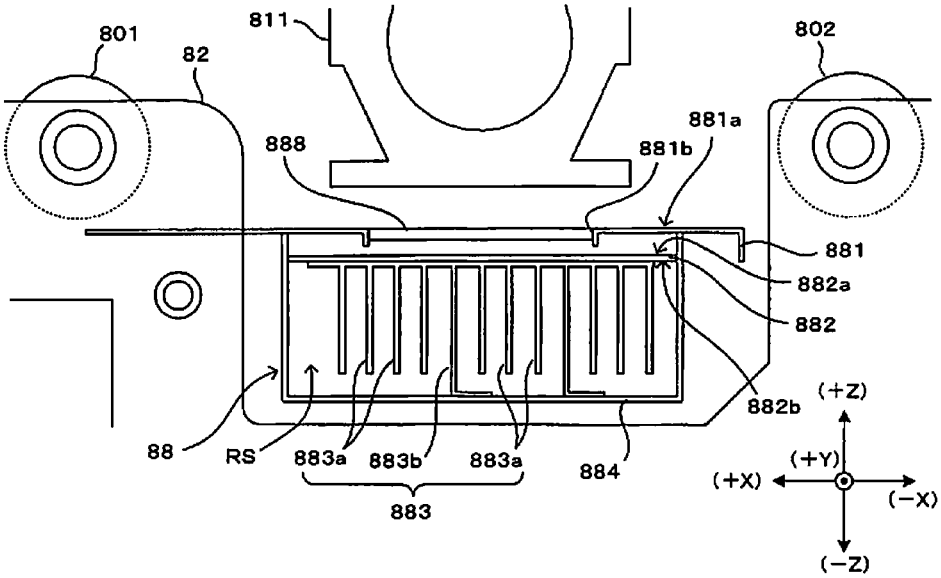
FIG. 8A is a drawing illustrating a first modification example.
Figure 8B:
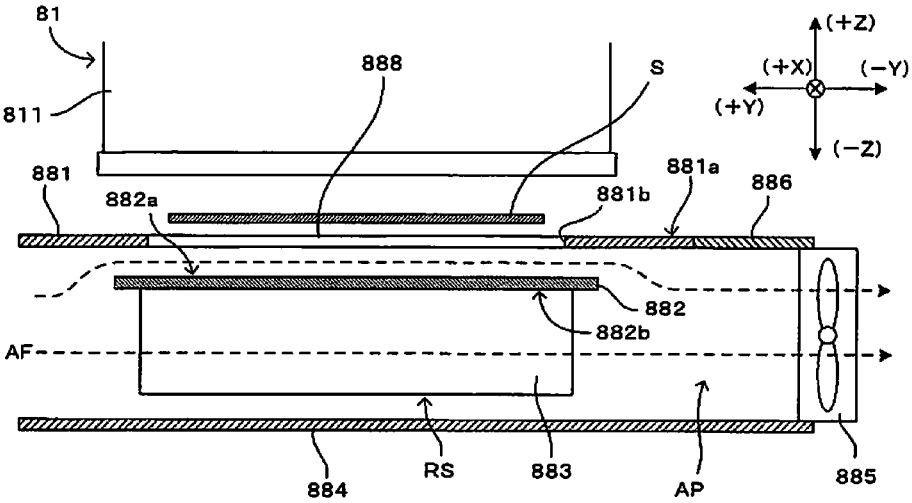
FIG. 8B is a drawing illustrating the first modification example.

FIGS. 8A and 8B are drawings illustrating a first modification example. As illustrated in FIG. 8A, in the first modification example, the opening 881*b* of the main stage 881 has fitted thereinto a window member 888 of flat shape, formed of a material (e.g. glass, quartz, or the like) having a high transmittance to the light irradiated from the UV lamp 81. In FIG. 8A, the upper surface of the window member 888 is arranged so as to be substantially flush with the front surface (regulating surface) 881*a* of the main stage 881, but so doing is not essential. With the configuration of such description, the window member 888 prevents the sheet S from entering into the interior of the opening 881*b*. The light irradiated from the UV lamp 81 passes through the window member 888 and, similarly with respect to the above-described embodiment, is incident on the interior of the opening 881*b*, the sub-stage 882 then being irradiated therewith. Because the light simply passes through the window member 888, the temperature of the window member 888 is not raised. In turn, even were the surrounding air to be warmed by a rise in temperature of the sub-stage 882 irradiated with the light, the window member 888 blocks off the space on the sub-stage 882 side and the space on the sheet S side from one another, and therefore the warmed air is prevented from flowing into the periphery of the sheet S.

In such a case, it would be necessary to prevent the warmed air from being retained in the space between the window member 888 and the sub-stage 882. For this purpose, as illustrated in FIG. 8B, it is desirable for the gap from the main stage 881 at the +Y-side and −Y-side end parts of the sub-stage 882 not to be closed off, but rather for a part of the air flowing through the air flow path AP to be made to flow through between the window member 888 and the sub-stage 882.

Figure 9A:
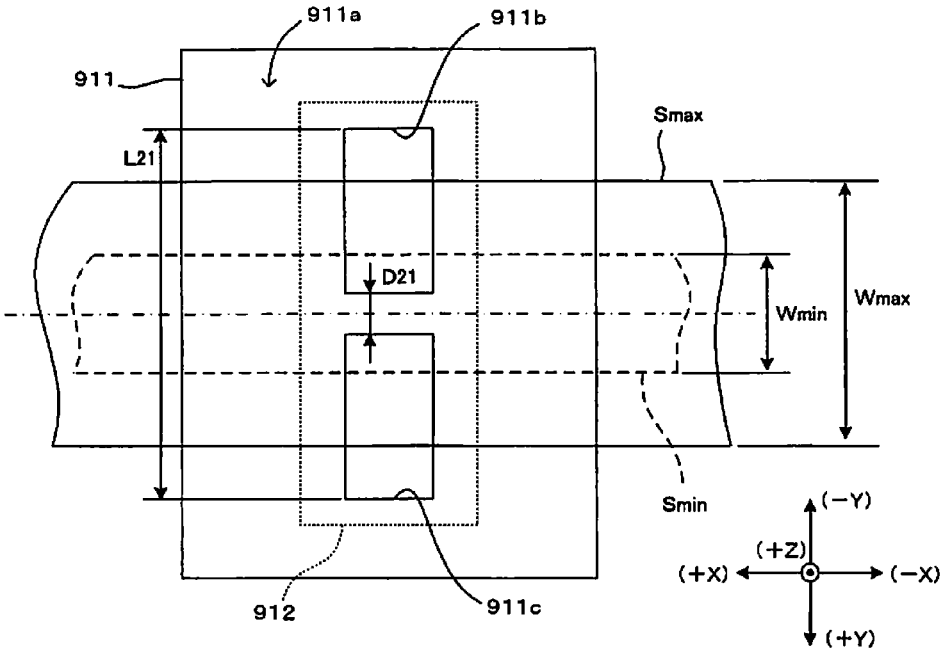
FIG. 9A is a drawing illustrating a second and third modification example.
Figure 9B:
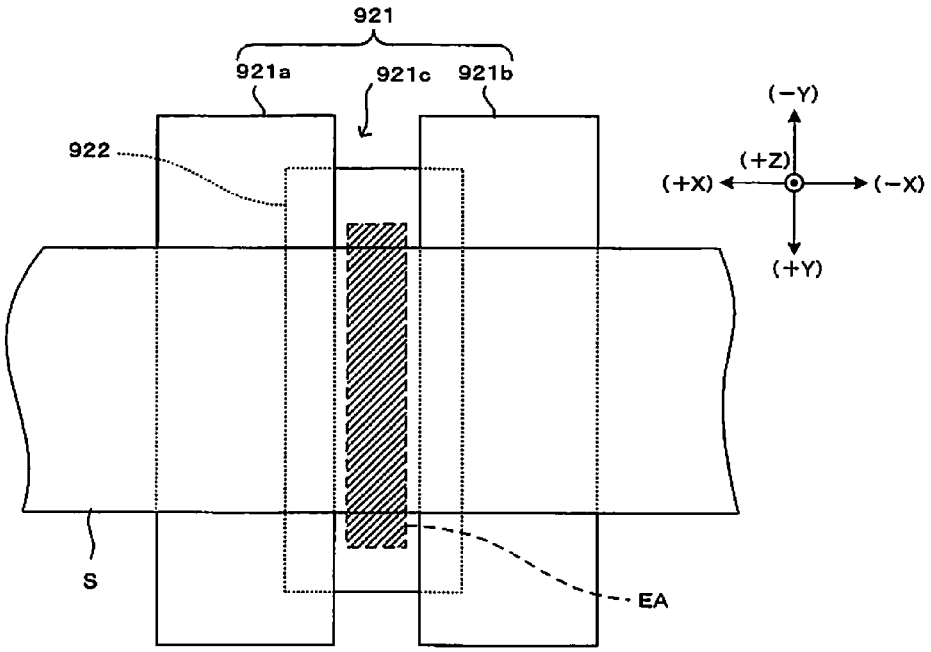
FIG. 9B is a drawing illustrating the second and third modification example.

FIGS. 9A and 9B are drawings illustrating a second and third modification example. In the second modification example illustrated in FIG. 9A, two openings 911*b*, 911*c* that are side by side in the Y-direction are provided to the regulating surface 911*a* of the main stage 911. A main stage 911 is continuous in the X direction at a portion corresponding to the center line of the sheet being conveyed, illustrated by the single-sot dashed line in the drawing. An interval D21 between the two openings 911*b*, 911*c* is smaller than a width Wmin of a narrowest sheet Smin. In turn, a length L21 in the Y direction combining the two openings 911*b*, 911*c* is greater than a width Wmax of a widest sheet Smax. A sub-stage 912 could be a continuous, integral one for the two openings 911 b, 911 c, but there may also be provided two sub-stages corresponding respectively to the two openings 911*b*, 911*c*.

Such a configuration corresponds to one where a bridge part extending in the X-direction is provided to the middle part of the opening 881*b* of the above-described embodiment. In such a case, the bridge part would be irradiated with the light coming from the UV lamp 81 in a case where the sheet is not present, but there is no possibility of light hitting the regulating surface 911 a in actual operation because in a state where the sheet is disposed, the bridge part would be shielded with even the narrowest sheet Smin. As such, an effect similar to that of the above-described embodiment is obtained. The fact that the bridge part is provided also makes it possible to more effectively restrict the entry of the sheet into the openings.

In turn, in the third modification example illustrated in FIG. 9B, the main stage 921 is split into two stages 921 a, 921 b separated in the X-direction, and the gap 921 c thereof functions in the same manner as the opening in the above-described embodiment. As with the second modification example, the two may be partially connected to one another at a portion shielded by the sheet. The sub-stage 922 is provided so as to cover the irradiation area EA of the light coming from the UV lamp, which is incident from the gap 921*c*.

As with the above-described embodiment, each of these configurations, too, prevents the light coming from the UV lamp from being directly incident on the main stage, and prevents the sheet from being warmed by a rise in temperature of the main stage.

As described above, in the embodiment and the modification examples thereof, the sheet S corresponds to a "recording medium of the invention. The print apparatus 1 incorporating the light irradiation unit 8 corresponds to a "print apparatus" of the invention. The process unit 3U functions as a "print part" of the invention, and the UV lamp 81 functions as an "irradiation part". The main stage 881 functions as a "backup part" of the invention, and the front surface 881 a of the main stage 881 functions as a "regulating surface".

The sub-stage 882 functions as a "light-receiving part" of the invention and the front surface 882*a* thereof corresponds to a "light-receiving surface", whereas the heat dissipation fins 883 function as "heat dissipation fins" of the invention. The sub-stage 882 and the heat dissipation fins 883, as an integrated unit, function as a "heat dissipation part" of the invention.

The cooling fan 885 functions as an "air flow generation part" of the invention. The main stage 881 and the sub-stage 882 function as an "isolating part" of the invention, along with the channel member 884, the closing-off members 882*c*, 882*d*, the cover member 886, and the like. The window member 888 in the first modification example functions as a "window member" of the invention.

The invention is in no way limited to the embodiments described above, and a variety of modifications outside of what is described above can be implemented, provided that there is no departure from the essence of the invention. For example, in the above-described embodiment, the light irradiation unit 8 is configured as an option unit that can be detached from the print apparatus 1 main body, but the invention would still function effectively with a configuration where the light irradiation unit is previously integrated in or built into the print apparatus.

Also, for example, in the above-described embodiment, the sub-stage 882 is provided to inside the opening 881*b* of the main stage 881 and the sub-stage 882 is made to receive the incident light, but the essential point is to provide an opening to the region of the main stage that is irradiated with light, guide the light into the opening, and prevent a rise in temperature of the main stage; the process for the light that is incident inside the opening is not limited to the above description.

As another example, the "heat dissipation part" in the above-described embodiment is one where the heat dissipation fins 883 are attached to the reverse surface 882*b* of the opposite side to the light-receiving surface 882*a* of the planar sub-stage 882, but these parts may also be integrally formed. That is to say, a heat dissipation plate that is flat on one surface and has heat dissipation fins provided to the other surface may be used as the "heat dissipation part", the flat surface thereof functioning as the "light-receiving surface". Also, regarding the approach to cooling, as well, there is no limitation to the approach of forced air cooling such as in the above-described embodiment, and it would be possible to apply any desired approach to cooling where a fan is not used, such as natural air cooling, water cooling, or one that uses a heat pipe.

As another example, in the above-described embodiment, the transfer of heat to the main stage 881 is suppressed by attaching the sub-stage 882 to the main stage 881 via the channel member 884. However, instead, a support member made of, for example, a material having an even lower thermal conductivity (e.g., a resin or ceramic) may be used to join the main stage and sub-stage together.

As another example, in the above-described embodiment, the tubular air flow path AP is formed by surrounding, with the sub-stage 882 and the channel member 884, the heat dissipation space RS to which the heat dissipation fins 883 are provided, but it is not essential that the heat dissipation space be a space that is isolated from other spaces in this manner, and, for example, the configuration may also be one where the heat dissipation fins are exposed to the internal space of an apparatus housing. In such a case, the internal space of the housing would be a "heat dissipation space". Regarding the path of conveyance for the sheet S, however, it is more preferable to be isolated from the heat dissipation space.

As another example, the main stage 881 of the above-described embodiment is one that normally is not contacted with the sheet S but, in a case where the sheet S has deviated away from the path of conveyance and toward the direction of separating from the UV lamp 81, has a function as a backup part for regulating the movement thereof. The invention would, however, still function effectively with a configuration where, for example, the sheet S is conveyed while also being contacted with the main stage at all times.

Also, the above-described embodiment is an apparatus that has four print heads 36*a* to 36*d* as a print part and forms a color image, but the numbers of print heads and ink colors are not limited thereto, and the invention could also be applied to an apparatus that forms, for example, a monochromatic image with one only color of ink.

Moreover, the print apparatus of the above-described embodiment is an apparatus that adheres photo-curable ink to a long sheet S serving as a recording medium and prints an image by an inkjet format, but the type of recording medium is not limited thereto, nor is the format of printing, and any kind can be used. What is adhered to the recording medium is also not limited to being ink, provided that what is adhered be a liquid that is photo-curable, nor is the purpose of printing limited to being image formation.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A print apparatus, comprises:

a print part configured to discharge a liquid onto a recording medium being conveyed;

a conveyance part configured to convey the recording medium in a conveyance direction;

an irradiation part arranged downwards in the conveyance direction relative to the print part and configured to irradiate the recording medium, onto which the liquid has been discharged, with light;

a backup part provided to an opposite side of the irradiation part relative to the recording medium in a first direction in which the backup part draws away from the irradiation part, the backup part having a regulating surface where a surface oriented toward the recording medium regulates movement of the recording medium in the first direction; and the regulating surface having an opening, and at a position of the regulating surface in the first direction, an irradiation area, in a plain surface parallel to the regulating surface, for the light irradiated from the irradiation part being positioned inside of an area that overlaps with the opening in the plain surface parallel to the regulating surface.

2. The print apparatus according to claim 1, further comprising a heat dissipation part having a light-receiving surface onto which the light having passed through the opening is incident, the heat dissipation part being configured to transport and dissipate heat received by the light-receiving surface to a heat dissipation space different from a gap space between the recording medium and the light-receiving surface, a distance between the recording medium and the light-receiving surface being greater than a distance between the recording medium and the regulating surface.

3. The print apparatus according to claim 2, wherein the heat dissipation part has a planar light-receiving part of which one principal surface serves as the light-receiving surface, and a heat dissipation fin that is provided to a surface of the light-receiving part on an opposite side to the light-receiving surface and are exposed to the heat dissipation space.

4. A print apparatus comprising a print part configured to discharge a liquid onto a recording medium being conveyed;

an irradiation part configured to irradiate the recording medium, onto which the liquid has been discharged, with light; and a backup part provided to an opposite side of the irradiation part relative to the recording medium, the backup part having a regulating surface where a surface oriented toward the recording medium regulates movement of the recording medium in a direction of drawing away from the irradiation part, the regulating surface having an opening, and an irradiation area for the light irradiated from the irradiation part fitting inside the opening as viewed in a plan view, the light-receiving part being constituted of a material having a higher thermal conductivity than that of a material constituting the regulating surface.

5. The print apparatus according to claim 2, further comprising an air flow generation part configured to create an air flow in the heat dissipation space.

6. The print apparatus according to claim 5, further comprising an isolating part configured to isolate the recording medium from the air flow.

7. The print apparatus according to claim 1, wherein the irradiation part has a lamp light source.

8. A print apparatus comprising:

a print part configured to discharge a liquid onto a recording medium being conveyed;

an irradiation part configured to irradiate the recording medium, onto which the liquid has been discharged, with light; and a backup part provided to an opposite side of the irradiation part relative to the recording medium, the backup part having a regulating surface where a surface oriented toward the recording medium regulates movement of the recording medium in a direction of drawing away from the irradiation part, the regulating surface having an opening, and an irradiation area for the light irradiated from the irradiation part fitting inside the opening as viewed in a plan view, the opening of the backup part being closed off by a window member that is transparent to the light irradiated from the irradiation part.

9. The print apparatus according to claim 1, further comprising a conveyance part configured to convey the recording medium relative to the irradiation part along a conveyance path that extends in a second direction perpendicular to the first direction, the regulating surface being arranged apart from the conveyance path in the first direction and being configured to regulate the recording medium in the first direction when the recording medium being conveyed by the conveyance part deviates from the conveyance path.

* * * * *